US008316912B2

(12) United States Patent
Okachi

(10) Patent No.: US 8,316,912 B2
(45) Date of Patent: Nov. 27, 2012

(54) SCREEN DEVICE

(75) Inventor: Yasubumi Okachi, Yokohama (JP)

(73) Assignee: Metaco Inc., Tokyo (JP)

( * ) Notice: Subject to any disclaimer, the term of this patent is extended or adjusted under 35 U.S.C. 154(b) by 0 days.

(21) Appl. No.: 12/996,696

(22) PCT Filed: May 1, 2009

(86) PCT No.: PCT/JP2009/058585

§ 371 (c)(1),
(2), (4) Date: Feb. 22, 2011

(87) PCT Pub. No.: WO2009/150911

PCT Pub. Date: Dec. 17, 2009

(65) Prior Publication Data

US 2011/0132558 A1 Jun. 9, 2011

(30) Foreign Application Priority Data

Jun. 9, 2008 (JP) ..... 2008-150950

(51) Int. Cl.
*E06B 3/48* (2006.01)

(52) U.S. Cl. ..... 160/84.06; 160/379

(58) Field of Classification Search ..... 160/31, 160/84.06, 194, 172 R, 369, 206, 199, 201, 160/379

See application file for complete search history.

(56) References Cited

U.S. PATENT DOCUMENTS 4,733,710 A * 3/1988 Haines ..... 160/84.06
4,825,929 A * 5/1989 Haines ..... 160/84.06
4,842,034 A * 6/1989 Haines ..... 160/84.04
5,377,737 A * 1/1995 Moriya et al. ..... 160/84.06
5,526,866 A * 6/1996 Flentge ..... 160/380
6,186,212 B1 * 2/2001 Tsuchida ..... 160/84.06
6,758,255 B2 * 7/2004 Sanz et al. ..... 160/84.06
7,472,738 B2 * 1/2009 Kamosawa et al. ..... 160/84.06
7,694,711 B2 * 4/2010 Okachi et al. ..... 160/245
7,726,377 B2 * 6/2010 Okachi ..... 160/84.06
7,810,542 B2 * 10/2010 Bonini ..... 160/31
7,810,543 B2 * 10/2010 Donatelli et al. ..... 160/31

(Continued)

FOREIGN PATENT DOCUMENTS

EP 0 999 335 A1 5/2000

(Continued)

OTHER PUBLICATIONS

International Search Report issued Jun. 2, 2009 in corresponding International Application No. PCT/JP2009/058585.

*Primary Examiner* — Katherine W Mitchell

*Assistant Examiner* — Johnnie A Shablack

(74) *Attorney, Agent, or Firm* — Wenderoth, Lind & Ponack, L.L.P.

(57) ABSTRACT

In a screen device, a pair of vertical rails 24 arranged on the front and back sides of a screen 8 so as to oppose to each other are connected by connecting members 30 and are fixed between a pair of sliding guide frames 10*a* and 10*b* with the intermediary of the screen. The connected vertical rails are integrally slidable in the direction parallel to the direction of sliding movement of a screen mounting frame, so that the screen is restrained from being deflected even when it receives a wind pressure in the closed state when the width in the opening and closing direction is large.

2 Claims, 4 Drawing Sheets

U.S. PATENT DOCUMENTS

| | | | | |
|---|---|---|---|---|
| 7,942,184 | B2 * | 5/2011 | Cech et al. | 160/84.05 |
| 7,963,312 | B2 * | 6/2011 | Okachi et al. | 160/31 |
| 7,984,744 | B2 * | 7/2011 | Karasawa et al. | 160/84.06 |
| 8,082,969 | B2 * | 12/2011 | Okachi | 160/84.06 |
| 2006/0162869 | A1 * | 7/2006 | Moriya et al. | 160/31 |
| 2006/0162871 | A1 * | 7/2006 | Kamosawa et al. | 160/84.06 |
| 2007/0068633 | A1 * | 3/2007 | Chino et al. | 160/31 |
| 2009/0020234 | A1 * | 1/2009 | Chino et al. | 160/31 |
| 2009/0277592 | A1 * | 11/2009 | Okachi et al. | 160/84.06 |
| 2010/0096093 | A1 * | 4/2010 | Okachi et al. | 160/313 |

FOREIGN PATENT DOCUMENTS

| | | | |
|---|---|---|---|
| JP | 6-173554 | | 6/1994 |
| JP | 06173555 | A * | 6/1994 |
| JP | 3323461 | | 6/2002 |

* cited by examiner

SCREEN DEVICE

TECHNICAL FIELD

The present invention relates to a multi-purpose screen device which can be used as a curtain, a blind, a screen window, and a partition.

BACKGROUND ART

As a device which resolves constraints on installation when being used as light blocking and light adjusting means such as a curtain or a blind or as a screen window or a partition and realizes smooth and stable opening and closing operation, the applicant of the present invention provides a screen device (for example, Patent Document 1).

In the screen device disclosed in Patent Document 1, a screen is mounted to one of a pair of screen mounting frames, which are arranged so as to oppose to each other and at least one of which is slidable, so as to allow free contraction and expansion between the both screen mounting frames, and a pair of sliding guide frames are disposed near both end portions of the screen, which are not the end portions mounted to the screen mounting frames. The sliding guide frames each include rigid units each having a pair of opposed sidewalls and a bridging portion mutually connecting the pair of sidewalls. The adjacent two rigid units are connected to each other so as to be rotatable. The sliding guide frame are flexuous, and at least one end thereof is a free end so as to be capable of being stored in and pulled out from the screen mounting frame. Portions of the sliding guide frames pulled out from the screen mounting frames in association with the sliding movement of the screen mounting frames are kept in its straightness. With the provision of the sliding guide frames, resolving of constraints on the installation and smooth and stable opening and closing operation are achieved.

The above described screen device may be manufactured into a desired size according to the size of an opening such as a window or a door frame, for example. However, the following problems are pointed out specifically in the case where the width in the opening and closing direction, that is, the width in the direction of sliding movement of the screen mounting frame is large.

When the screen receives strong wind in a state in which the screen is expanded and hence the screen device is closed, the screen may be deflected significantly by the wind pressure. When the screen is significantly deflected in this manner, a large gap is generated with respect to the sliding guide frame, and hence the functions of the screen device such as the light blocking effect and the insect-proof property are impaired.

In the screen device having the sliding guide frames disposed near both the upper and lower end portions of the screen, the upper sliding guide frame is supported from below by the rigidity of the screen, so that the straightness of the sliding guide frame pulled out from the screen mounting frame can be held stably even when the width of the opening and closing direction is significantly large. However, when the screen is deflected significantly as described above, the support by the screen is insufficient, and hence the upper sliding guide frame is deflected by its own weight, whereby the opening and closing operation of the screen device is impaired.

From the above-described problems, the deflection of the upper sliding guide frame disposed in the vicinity of the upper end portion of the screen due to its own weight can be resolved by a cantilever in the screen device (Patent Document 2) which is proposed by the applicant of the present invention. However, since the cantilever does not have a function to restrain the deflection due to the wind pressure of the screen, other technical means is required in order to solve the above-described problem caused by the deflection of the screen due to the wind pressure drastically.

Patent Document 1: Japanese Patent No. 3323461

Patent Document 2: JP-A-2002-242563

SUMMARY OF INVENTION

Problems to be Solved by the Invention

In view of such circumstances as described above, it is an object of the present invention to provide a screen device in which a deflection of a screen can be restrained even when the screen receives a wind pressure in a closed state when the width in the opening and closing direction is large.

Means for Solving the Problems

In order to solve the above-described problems, the present invention has following characteristics.

According to the first aspect of the invention, there is provided a screen device including: a pair of screen mounting frames which are arranged so as to oppose to each other and at least one of which is slidable; a screen mounted between the both screen mounting frames so as to be capable of contracting and expanding; and a pair of sliding guide frames disposed near both end portions of the screen, which are not the end portions mounted to the screen mounting frames, the sliding guide frames each include rigid units, the adjacent two rigid units being connected to each other so as to be rotatable, the rigid units each having a pair of sidewalls opposed to each other and a bridging portion connecting the both sidewalls, the sliding guide frames each being flexuous and having a free end at least at one end thereof to be capable of being stored in and pulled out from the each screen mounting frame, while portions of the sliding guide frames pulled out from the screen mounting frames when being pulled out in association with the sliding movement of the screen mounting frames keeping its straightness, wherein the pair of vertical rails arranged on the front and back sides of the screen so as to oppose to each other is connected by a connecting member and hence are fixed between the pair of sliding guide frames with the screen sandwiched therebetween and the connected vertical rails are integrally slidable in the direction parallel to the direction of sliding movement of the screen mounting frames.

In the characteristics in the first aspect of the invention, the second aspect of the invention is characterized in that the connecting member includes a spacer, the connecting member connects the pair of vertical rails by bringing the spacer into abutment with one of the front and back sides of the screen, a gap having a thickness corresponding to the thickness of the spacer is formed between one of the vertical rails and the screen in the connected vertical rails, and a tensioning member extended between the pair of screen mounting frames passes through the screen via the gap.

In the characteristics in the first and second aspects of the invention, the third aspect of the invention is characterized in that the respective sliding guide frames include a plurality of sliding guide frame units connected to each other, and the pair of vertical rails are fixed to connecting portions of the sliding guide frame unit positioned so as to oppose to each other in the both sliding guide frames.

Advantage of the Invention

According to the above-described first aspect of the invention, the connected vertical rails slide in association with the sliding movement of the screen mounting frames, and reinforce the surface strength of the screen expanded between the pair of screen mounting frames. Therefore, the screen can be restrained from being deflected significantly by the wind pressure even when it receives a strong wind. Accordingly, the functions of the screen device such as the light blocking effect or the insect-proof property are stably realized. Also, the upper slide guide frame disposed near the upper end portion of the screen is restrained from being deflected due to its own weight, and the opening and closing operation of the screen device is stably realized.

According to the second aspect of the invention, in addition to the effect of the first invention, the tensioning member extended through the screen for enhancing the surface strength of the screen or the like is prevented from interfering with the vertical rails.

According to the third aspect of the invention, in addition to the effect of the first or second invention, assembly of the vertical rails is facilitated, and the stable sliding movement of the vertical rails is realized.

DETAILED DESCRIPTION OF THE INVENTION

Figure 1:
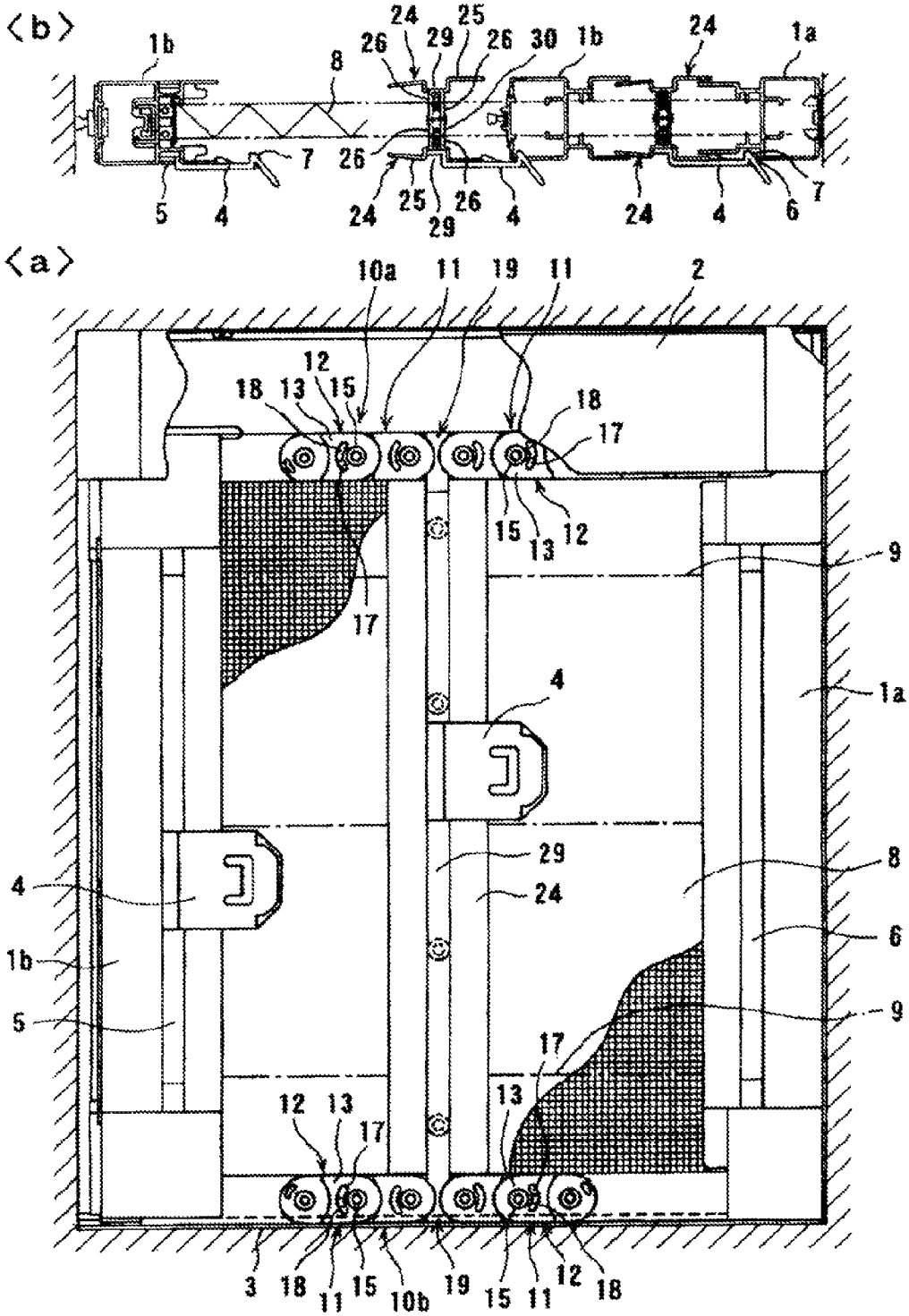
FIGS. 1(*a*) and (b) are a front view showing an embodiment of a screen device according to the present invention and a cross-sectional view of an upper portion thereof, respectively.
Figure 2:
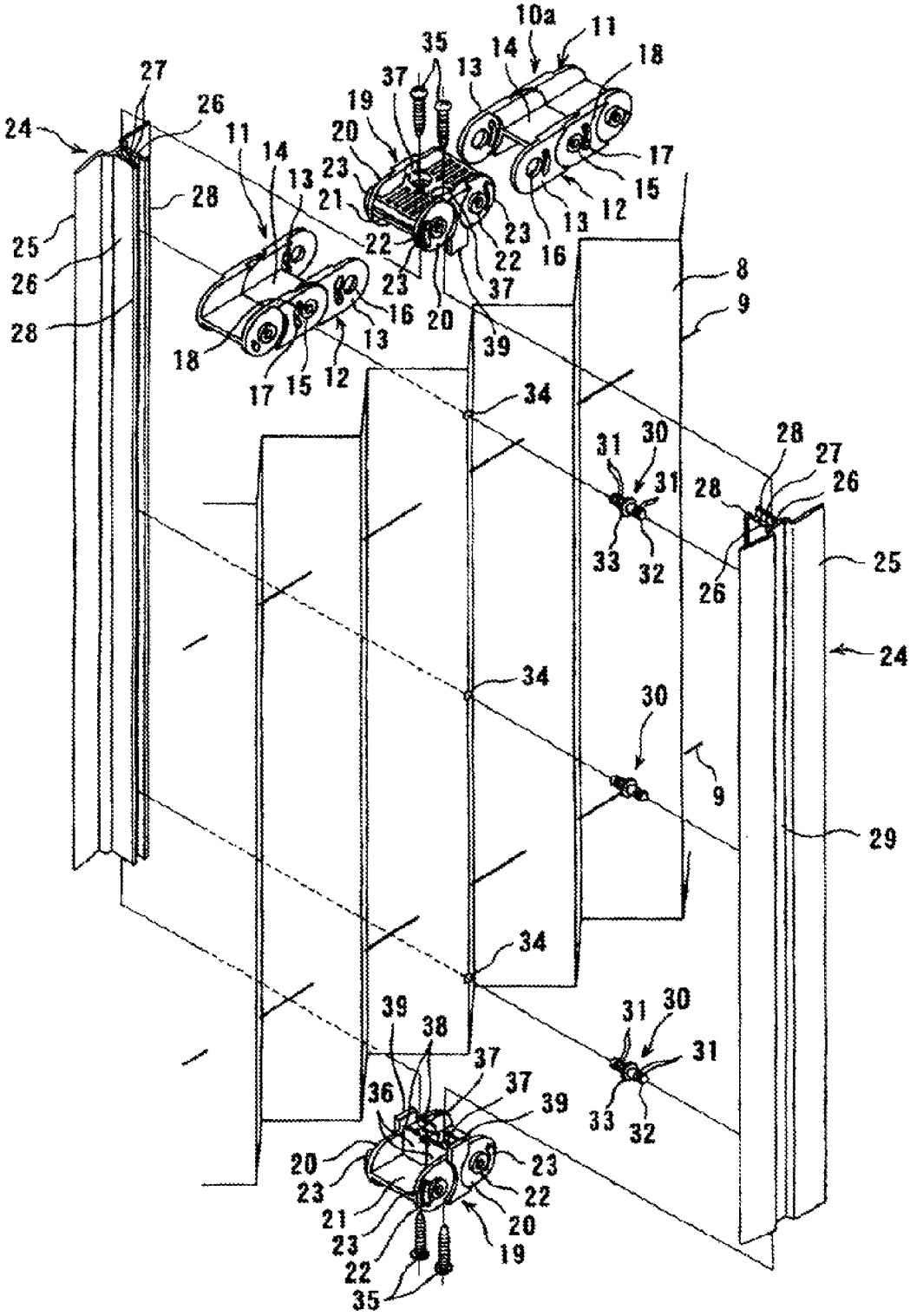
FIG. 2 is an exploded perspective view of principle portions showing a peripheral part of vertical rails of the screen device shown in FIGS. 1(*a*) and (b).

FIGS. 1(*a*) and (*b*) are a front view showing an embodiment of a screen device according to the present invention and a cross-sectional view of an upper portion thereof respectively. FIG. 2 is an exploded perspective view of principle portions showing a peripheral part of vertical rails of the screen device shown in FIGS. 1(*a*) and (*b*).

The screen device shown in FIGS. 1(*a*) and (*b*) and FIG. 2 includes a pair of screen mounting frames 1*a*, 1*b*. The screen mounting frame la is fixed to the right side of an inner edge of an opening, while the screen mounting frame 1*b* is disposed so as to be slidable in the lateral direction of the opening toward the left side of the inner edge of the opening. The both screen mounting frames 1*a*, 1*b* are opposed to each other. An upper rail 2 is disposed on the upper side of the inner edge of the opening along the lateral direction of the opening, and upper end portions of the screen mounting frames 1*a*, 1*b* are stored inside the upper rail 2. A lower rail 3 is disposed on the lower side of the inner edge of the opening along the lateral direction of the opening. The screen mounting frame 1*b* on the movable side is provided so as to be capable of sliding in the lateral direction of the opening along the upper rail 2 and the lower rail 3.

A handle 4 is disposed on the screen mounting frame 1*b* to facilitate the opening and closing operation of the screen device. The handle 4 is fixed to the screen mounting frame 1*b* by being connected at one end portion thereof to a depression 5 formed in the screen mounting frame 1*b* so as to extend in the vertical direction. The screen mounting frame 1*a* on the fixed side is also formed with a depression 6 so as to extend in the vertical direction. Therefore, the screen mounting frames 1*a*, 1*b* have an appearance of substantially lateral symmetry in the screen device. The depression 6 is also engageable with a protrusion 7 protruding from the handle 4 on the back side thereof. With the engagement with the protrusion 7, the screen mounting frame 1*b* is not operated inadvertently when the screen device is opened, so that the opened state can be held.

A screen 8 formed of a net is mounted between the screen mounting frames 1*a*, 1*b*. The screen 8 is pleated by pleating process and is contractible and expandable freely between the screen mounting frames 1*a*, 1*b*. In other words, when the screen mounting frame 1*b* slides toward the left of the inner edge of the opening, the screen 8 is expanded in the opening, and blocks an entry of insects or the like. The screen 8 contracts when the screen mounting frame 1*b* slides toward the right of the inner edge of the opening, and is folded between the screen mounting frames 1*a*, 1*b* and stored therein.

The screen 8 may be formed of a cloth or a resin sheet in addition to the net, and may be formed of adequate materials according to the applications of the screen device. Alternatively, the contractible and expandable configuration may be achieved by, for example, a honeycomb structure in addition to the pleat formed by the pleating process.

The screen 8 is provided with tensioning members 9 extending in the direction of contraction and expansion. Suitable members which generate a tension such as a string or a wire may be employed as the tensioning member 9, and a plurality of tensioning members 9 may be provided at regular intervals corresponding to the width of the screen 8 in the height direction. The tensioning members 9 penetrate through the pleated screen 8 in the direction of contraction and expansion to support the screen 8. The screen 8 is secured in self-standing property and is enhanced in surface strength by the tensioning members 9. Disposition of the tensioning members 9 is arbitrary and may be omitted.

The screen device is provided with a pair of sliding guide frames 10*a*, 10*b* at both end portions, which are not the end portions mounted to the screen mounting frames 1*a*, 1*b* of the screen 8, that is, in the vicinity of the both upper and lower end portions. The sliding guide frames 10*a*, 10*b* are each composed of two sliding guide frame units 11 connected to each other. The sliding guide frame units 11 are each composed of a plurality of rigid units 12, and have a predetermined length.

The rigid unit 12 includes a pair of sidewalls 13 arranged so as to oppose to each other and a bridging portion 14 connecting the both sidewalls 13 with respect to each other. The sidewall 13 is provided with a projection 15 projecting outwardly at one end portion in the longitudinal direction and a through hole 16 to allow engagement of the projection 15 therewith at the other end portion. The sidewall 13 is also provided with a small projection 17 at a position adjacent to the projection 15 so as to project outward in the direction opposite from the through hole 16 and is formed with a substantially crescent-shaped elongated hole 18 at a position adjacent to the through hole 16 on the side of the projection 15. Two such the rigid units 12 adjacent to each other are rotatably connected by fitting and engaging the projection 15 with the through hole 16 from inside the sidewall 13, and inserting the small projection 17 into the elongated hole 18, thereby forming the sliding guide frame unit 11. The sliding guide frame unit 11 is flexuous because two of the rigid units 12 adjacent to each other are rotatable, and is capable of maintaining its straightness by the small projection 17 coming into contact with one end of the elongated hole 18 in the longitudinal direction, thereby restricting the rotation of the rigid unit 12. In order to keep the straightness of the sliding guide frame unit 11, the rotation of the rigid unit 12 may be restricted by providing the rigid unit 12 with disalignment portions by notching a front surface of the bridging portion 14 at one edge portion and a back surface at the other edge portion and by overlapping the disalignment portions at a timing when the small projection 17 comes into contact with the elongated hole 18.

The two sliding guide frame units 11 configured in this manner are connected by a connecting unit 19 at one end portion of each. The connecting unit 19 includes a pair of sidewalls 20 arranged so as to oppose to each other and a bridging portion 21 connecting the both sidewalls 20 with respect to each other. The sidewall 20 is provided with projections 22 projecting outwardly at both end portions in the longitudinal direction, and the projection 22 has substantially the same shape and size as the projection 15 of the rigid unit 12, and is engageable with the through hole 16 of the rigid unit 12. The sidewall 20 is provided with a substantially crescent-shaped projection 23 at a position adjacent to the projection 22 on the end edge side thereof. The projection 23 is engageable with the substantially crescent-shaped elongated hole 18 of the rigid unit 12.

The two sliding guide frame units 11 are connected via the connecting unit 19 by fitting and engaging the projection 22 of the connecting unit 19 into the through hole 16 of the rigid unit 12 positioned at one end of each from inside and fitting and engaging the projection 23 into the elongated hole 18 from the inside, whereby the sliding guide frames 10*a*, 10*b* are formed. Therefore, the both sliding guide frames 10*a*, 10*b* are flexuous and are capable of keeping its straightness in the same manner as the sliding guide frame units 11.

The sliding guide frames 10*a*, 10*b* have free ends at both ends in the longitudinal direction, that is, at ends of the sliding guide frame units 11 which are not connected by the connecting unit 19, and are capable of being stored in and pulled out from the screen mounting frames 1*a*, 1*b*. When the screen mounting frame 1*b* is slid in the lateral direction of the opening toward the left side of the inner edge of the opening, the sliding guide frames 10*a*, 10*b* are pulled out from the screen mounting frames 1*a*, 1*b*, and the portions pulled out therefrom, maintain its straightness. In contrast, when the screen mounting frame 1*b* is slid toward the right side of the inner edge of the opening, the sliding guide frames 10*a*, 10*b* are bent at the upper end portion and the lower end portion of the screen mounting frames 1*a*, 1*b*, and are stored in the interior of the screen mounting frames 1*a*, 1*b*. Such storing and pulling out of the sliding guide frames 10*a*, 10*b* are performed along the upper rail 2 and the lower rail 3, and the storing and pulling out of the upper sliding guide frame 10*a* are performed inside the lower end portion of the upper rail 2.

The connecting units 19 positioned at the connecting portion between the two sliding guide frame units 11 of the sliding guide frames 10*a*, 10*b* are arranged so as to oppose to each other in the vertical direction.

Then, in the screen device, a pair of vertical rails 24 are disposed on both front and back sides of the screen 8 at a substantially center portion of the screen 8 in the direction of contraction and expansion. The vertical rails 24 each include a body strip 25 having substantially the same length as the height between the upper and lower sliding guide frames 10*a*, 10*b*, and two connecting strips 26 projecting from the back side of the body strip 25 at a center portion in the width direction and extending in the longitudinal direction of the body strip 25. Projecting from opposed inner surfaces of the two connecting strips 26 are a plurality of ribs 27, and the respective ribs 27 are arranged so as to oppose at the two connecting strips 26. Formed on the end edge portion of the connecting strips 26 positioned on the opposite sides from the body strip 25 are flanges 28, and the flanges 28 are directed outward from the two connecting strips 26. A depression 29 like the depressions 5, 6 formed on the screen mounting frames 1*a*, 1*b* is formed at the widthwise center portion on the front surface portion of the body strip 25.

Figure 3:
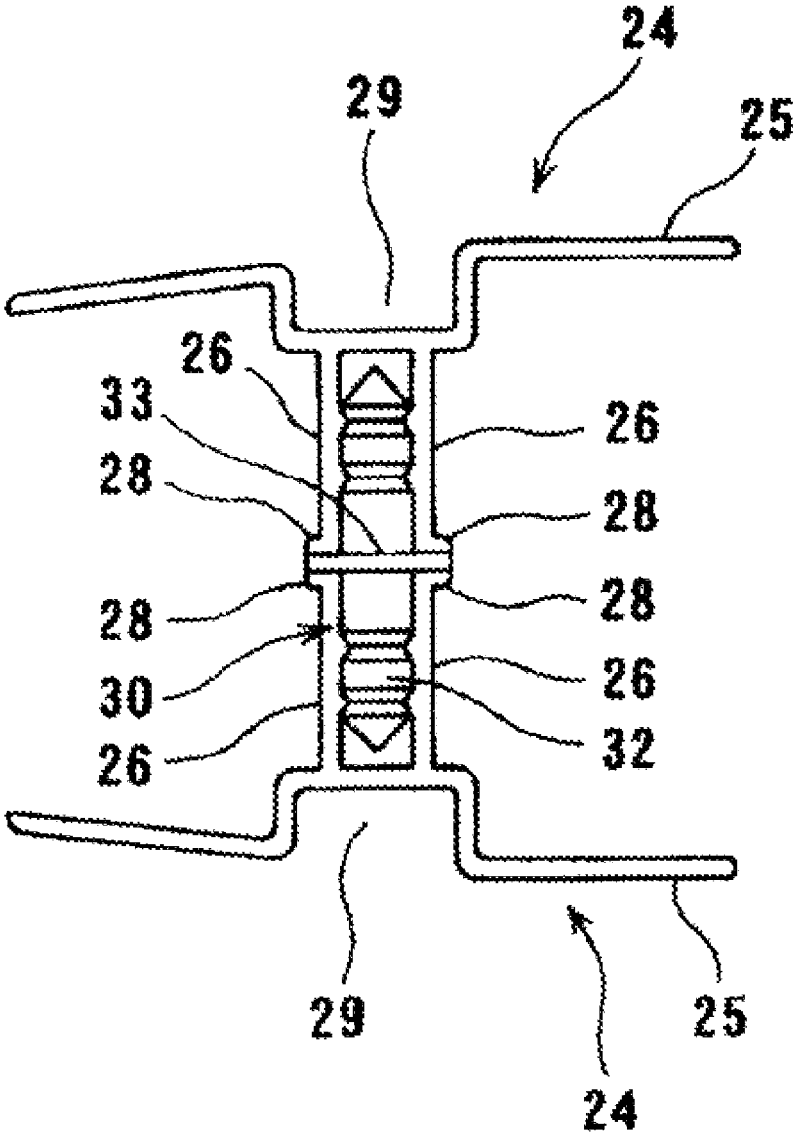
FIG. 3 is a cross-sectional view of a principal portion showing a connected mode of the vertical rails in the screen device shown in FIGS. 1(*a*) and (b).

The vertical rails 24 as described above are arranged one each on the front and back sides of the screen 8 so as to oppose to each other with the connecting strips 26 abutted against each other and are connected to each other with connecting members 30. The connecting members 30 each include a screw portion 32 formed with grooves 31 on an outer peripheral portion thereof and being pointed at both end portions in the longitudinal direction and a disk-shaped spacer 33 provided at substantially a center portion of the screw portion 32 in the longitudinal direction. A pair of the vertical rails 24 are connected by the connecting members 30 into a unit by arranging one of the vertical rails 24 close to one of the front or back surface of the screen 8, screwing the screw portions 32 of the connecting members 30 into through holes 34 formed on a fold line of the pleat of the screen 8 between the connecting strips 26 of the vertical rails 24 as shown in FIG. 3, engaging the ribs 27 with the grooves 31, arranging the spacer 33 into abutment with the other surface of the screen 8, arranging the other vertical rail 24 close to the other surface of the screen 8, screwing the screw portions 32 of the connecting members 30 between the connecting strips 26 of the vertical rails 24, and engaging the rib 27 with the grooves 31. In the connected state, the flange 28 of the connecting strip 26 of one of the vertical rails 24 comes into abutment with the front or back surface of the spacers 33, and the screen 8 is sandwiched between the pair of vertical rails 24. However, gaps having a thickness corresponding to the thickness of the spacer 33 are formed between one of the vertical rails 24 and the screen 8. With the provision of these gaps, an interference between the tensioning members 9 penetrating through the screen 8 in the direction of contraction and expansion and the vertical rails 24 can be prevented, and the tensioning members 9 are penetrated through the screen 8 via these gaps.

The vertical rails 24 are fixed to the connecting units 19 arranged in the sliding guide frames 10*a*, 10*b* so as to oppose in the vertical direction by screws 35. In the connecting unit 19, joint portions 36 are formed at a substantially center portion of the bridging portion 21 in the longitudinal direction so as to protrude therefrom, and the joint portions 36 are arranged one each insides the respective sidewalls 20. The joint portions 36 are each formed with a through hole 37 at a substantially center portion thereof so as to penetrate from the bridging portion 21, and the joint portions 36 are formed with locking strips 38 at both end portions in the longitudinal direction of the connecting unit 19 so as to extend upright therefrom. Supporting strips 39 are formed on both sidewalls 20 of the connecting unit 19 at positions corresponding to the joint portions 36 so as to extend upright therefrom. The width of the supporting strip 39 substantially matches the width of the depression 29 formed on the body strip 25 of the vertical rail 24.

Figure 4:
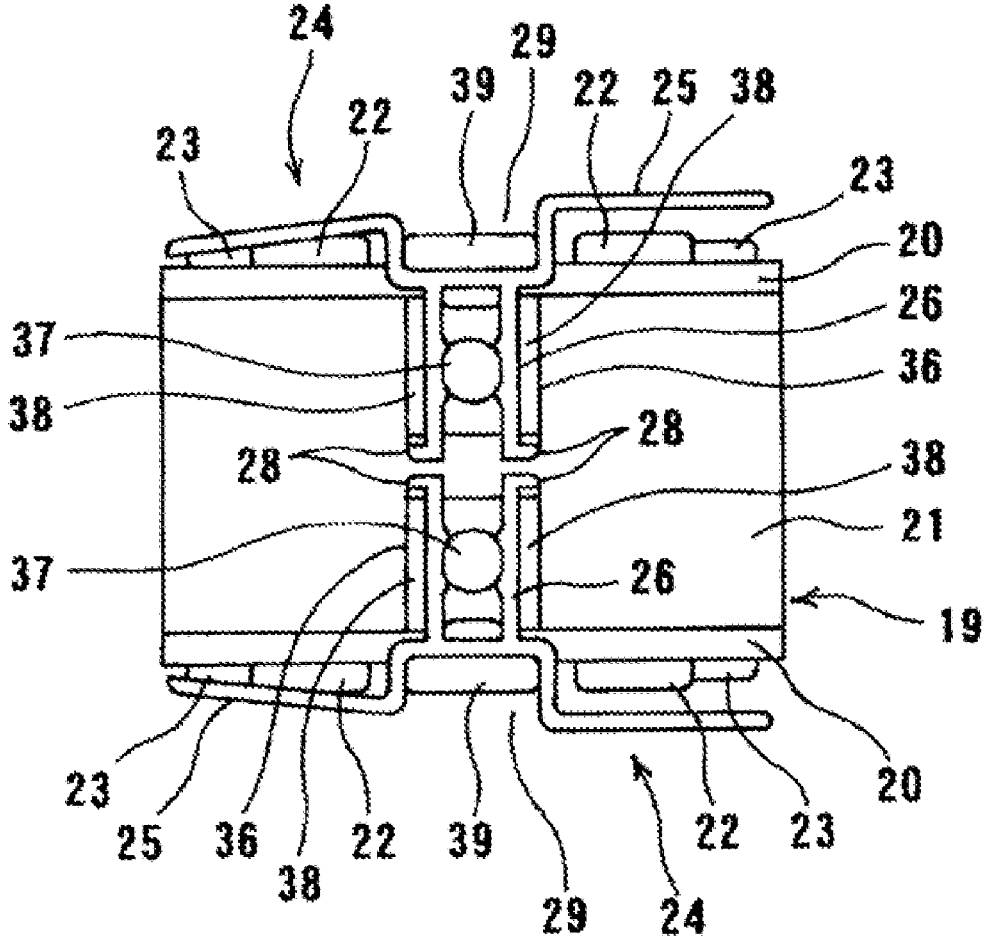
FIG. 4 is a cross-sectional view of a principal portion showing a fixed mode of the vertical rails in the screen device shown in FIGS. 1(*a*) and (b).

As shown in FIG. 4, at upper and lower end portions, the connecting strips 26 are inserted inside the locking strips 38 and brings the flanges 28 into contact with the end surfaces inside the locking strips 38 to cause the connecting strips 26 to be locked by the locking strips 38, and the supporting strips 39 are inserted into the depressions 29 of the body strips 23 to cause the body strips 23 to be supported by the supporting strips 39, so that the vertical rails 24 are fixed to the connecting units 19 by the screw 35 screwed from the bridging portions 21. In this manner, the vertical rails 24 fixed between the sliding guide frames 10*a*, 10*b* are configured so that the both vertical rails 24 are integrally slidable in the direction parallel to the direction of sliding movement of the screen mounting frame 1*b* in association with the sliding guide frames 10*a*, 10*b* stored and pulled out with the sliding movement of the screen mounting frame 1*b*. The sliding movement of the vertical rails 24 is stably realized. With the fixation of the sliding guide frame units 11 to the connecting units 19 positioned at the connecting units thereof in the sliding guide frames 10*a*, 10*b*, assembly of the vertical rails 24 into the screen device is facilitated.

According to the screen device as described above, the pair of vertical rails 24 arranged on the front and back sides of the screen 8 so as to oppose to each other are connected by the connecting members 30 and are fixed between the pair of sliding guide frames 10*a*, 10*b* with the intermediary of the screen 8. The connected vertical rails 24 are integrally slidable in the direction parallel to the direction of sliding movement of the screen mounting frame 1*b*, so that the connected vertical rails 24 are slid in association with the sliding movement of the screen mounting frame 1*b* to reinforce the surface strength of the screen 8 expanded between the pair of screen mounting frames 1*a*, 1*b*. Therefore, in the case of the large screen device having a large width in the opening and closing direction, the screen 8 can be restrained from being deflected significantly by the wind pressure even when it receives a strong wind in the closed state. Therefore, the functions of the screen device such as the light blocking effect or the insect-proof property are stably realized.

The upper sliding guide frame 10*a* is sufficiently supported by the screen 8 which is restrained from being significantly deflected and, in addition, is also supported by the vertical rails 24. Therefore, the sliding guide frame 10*a* is restrained from being deflected by its own weight and opening and closing operation of the screen device is stably realized.

The vertical rails 24 may be provided with the handle 4 in the same manner as the screen mounting frame 1*b*, so that the sliding movement of the vertical rails 24 may be operated using the handle 4. In this case, the handle 4 can be fixed to the vertical rail 24 by connecting at one end portion thereof to the depression 29. The handle 4 disposed on the vertical rail 24 is capable of engaging with the depression 6 formed on the screen mounting frame 1*a* on the fixed side using the protrusion 7 protruding on the back side thereof, so that the vertical rails 24 can be kept in the opened state without being inadvertently operated when the screen device is opened. In order to enable the engagement with the depression 6 as described above, the handle 4 disposed on the vertical rail 24 is needed to be mounted at a height different from the handle 4 disposed on the screen mounting frame 1*b*.

The position of arrangement of the vertical rails 24 on the screen 8 is not limited to the substantially center portion of the screen 8 in the direction of contraction and expansion, but may be adjusted according to the size of the screen device. For example, the vertical rails 24 can be arranged corresponding to the position of arrangement of the connecting unit in the sliding guide frame, and a plurality of vertical rails 24 may be arranged at a regular interval in the direction of contraction and expansion of the screen.

Furthermore, the screen mounting frame 1*a* may be configured to be slidable in the lateral direction of the opening in the same manner as the screen mounting frame 1*b* instead of fixing to the right side of the inner periphery of the opening.

REFERENCE NUMERALS

1*a*, 1*b* screen mounting frame
8 screen
9 tensioning member
10*a*, 10*b* sliding guide frame
11 sliding guide frame unit
12 rigid unit
13 sidewall
14 bridging portion
24 vertical rail
30 connecting member
33 spacer

The invention claimed is:

1. A screen device comprising:

a pair of screen mounting frames disposed opposite to each other, at least one of which is slidable;

a screen mounted between said screen mounting frames so as to be capable of being opened and closed;

a pair of sliding guide frames each of which is disposed near respective side of said screen which is not mounted to one of said screen mounting frames, at least one end of each sliding guide frame being a free end which is capable of being received in and withdrawn from inside of one of said screen mounting frames, wherein each sliding guide frame is formed of a plurality of interconnected rigid units, each rigid unit having a pair of sidewalls disposed opposite to each other and a bridging portion interconnecting said sidewalls, and wherein adjacent ones of said rigid units are rotatable relative to each other, whereby each sliding guide frame is bendable and preserves straightness of a withdrawn portion of said sliding guide frame when said sliding guide frame is withdrawn from one of said screen mounting frames in accordance with sliding movement of one of said screen mounting frames;

a pair of vertical rails disposed opposite to each other, said screen being arranged between said vertical rails, said vertical rails being connected to each other, wherein each vertical rail has a length equal to a distance between said sliding guide frames;

a connecting member for connecting said vertical rails to each other, said connecting member having a spacer, wherein one side of said spacer abuts on a front or back surface of said screen; and a tensioning member stretching between said pair of screen mounting frames, wherein opposite ends of each vertical rail are fixed to said sliding guide frames, respectively, said vertical rails being capable of sliding parallel to a sliding direction of said screen mounting frames, wherein a clearance with a width equal to a width of said spacer is formed between said screen and one of said vertical rails, and wherein the tensioning member passes through said clearance.

2. The screen device according to claim 1, wherein each sliding guide frame is formed of a plurality of a sliding guide frame units connected to each other at a connecting portion, each sliding guide frame unit being formed of a plurality of said rigid units, wherein said connecting portions of said sliding guide frames respectively oppose each other, and wherein said opposite ends of each vertical rail are fixed to connecting portions of said sliding guide frame units of said sliding guide frames, respectively.

* * * * *